United States Patent [19]

Owen

[11] 4,354,433

[45] Oct. 19, 1982

[54] APPARATUS FOR CUTTING PIPE

[75] Inventor: Harrold D. Owen, Forth Worth, Tex.

[73] Assignee: Pengo Industries, Inc., Fort Worth, Tex.

[21] Appl. No.: 131,096

[22] Filed: Mar. 18, 1980

[51] Int. Cl.[3] ..... F42B 1/02

[52] U.S. Cl. ..... 102/307; 102/308; 102/310; 102/320; 102/378; 89/1 B

[58] Field of Search ..... 102/24 HC, 56 SC, 307, 102/308, 310, 320, 378; 175/4.6; 89/1 B, 1 C

[56] References Cited

U.S. PATENT DOCUMENTS 3,013,491 12/1961 Poulter ..... 102/56 SC X
3,233,688 2/1966 Bell ..... 175/4.6
3,991,679 11/1976 Savitt et al. ..... 102/24 HC X
4,166,417 9/1979 Woodcock et al. ..... 102/24 R X
4,280,407 7/1981 Allen et al. ..... 102/320

*Primary Examiner*—Peter A. Nelson
*Attorney, Agent, or Firm*—Wm. T. Wofford; James C. Fails; Arthur F. Zobal

[57] ABSTRACT

The invention pertains to an improved annular shaped charge of a type to be used in the shaped charge carrier of pipe cutting or severing apparatus. The improved annular shaped charge is made up of eight or more shaped charge segments disposed in side to side abutting relation. Each shaped charge segment has a die formed metal band and charge load. The invention also pertains to methods of making said annular shaped charge and the shaped charge segments, which methods are described.

4 Claims, 12 Drawing Figures

31
35
37
39
11
29
43
15
17
19
79
83
13
15
19
103
99
105
101
97
107
27
97
21
25
23

APPARATUS FOR CUTTING PIPE

FIELD OF THE INVENTION

This invention concerns apparatus utilizing so called shaped charge techniques for cutting or severing pipe, particularly pipe in a well bore, and method pertaining thereto.

DESCRIPTION OF THE PRIOR ART

Pipe cutting apparatus of the relevant type usually comprises a shaped charge carrier having the general configuration of a short cylinder or disk provided with a circumferential slot that conforms with the shaped charge side and end surface shape. The cutter may be of a type that is suspended within a pipe to be cut, in which case the shaped charge is disposed to face radially outward. If the cutter is of a type that surrounds the pipe to be cut, then the shaped charge is disposed to face radially inward. The shaped charge has the form of an annulus which may be made up of two semi-circular segments; or which in some cases is made up of two complimentary annulus halves. U.S. Pat. Nos. 2,587,244, 2,699,721, 2,684,030, 2,761,384, 2,935,044 and 3,057,295 exemplify the prior art.

The objective of this invention is to provide improved shaped charge configurations for the relevant type pipe cutting apparatus and improved methods of making said shaped charges.

SUMMARY OF THE INVENTION

The present invention pertains to pipe cutting or severing apparatus comprising a shaped charge carrier having the general configuration of a short cylinder or disk provided with a circumferential slot or groove that is shaped to conform with the side and end surface shape of an annular shaped charge. In accordance with the invention, an annular shaped charge to be disposed in such slot or groove is made up of eight or more shaped charge segments that are disposed in side to side abutting relation. Each shaped charge segment has a die formed metal band and charge load.

One aspect of the invention involves methods of making a relevant shaped charge segment, including steps of forming a strip of sheet metal material of suitable length into a band; filling the band and pressing within same a charge load; and die forming the filled band into a shaped charge segment having predetermined peripheral shape. The open side faces of the shaped charge segment are tapered to subtend a predetermined angle, which is substantially equal to 360° divided by the number of shaped charge segments to be used to make up the particular annular shaped charge. This tapering may be accomplished either in the die forming operation or by milling after the die forming operation.

DESCRIPTION OF THE PREFERRED EMBODIMENTS

Figure 1:
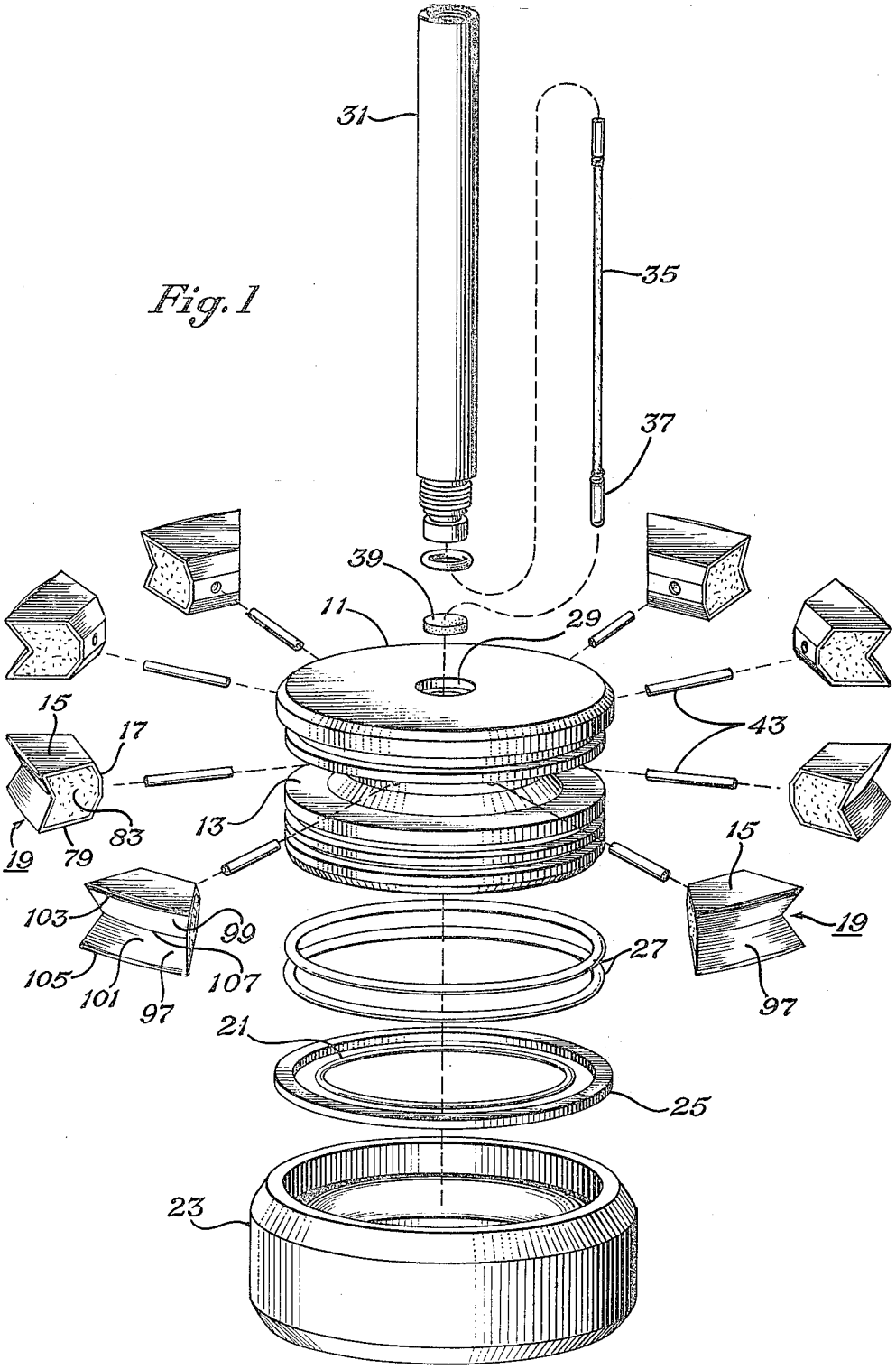
FIG. 1 is a schematic exploded view showing a relevant type pipe cutting apparatus utilizing an improved shaped charge configuration in accordance with a preferred embodiment of the invention.
Figure 2:
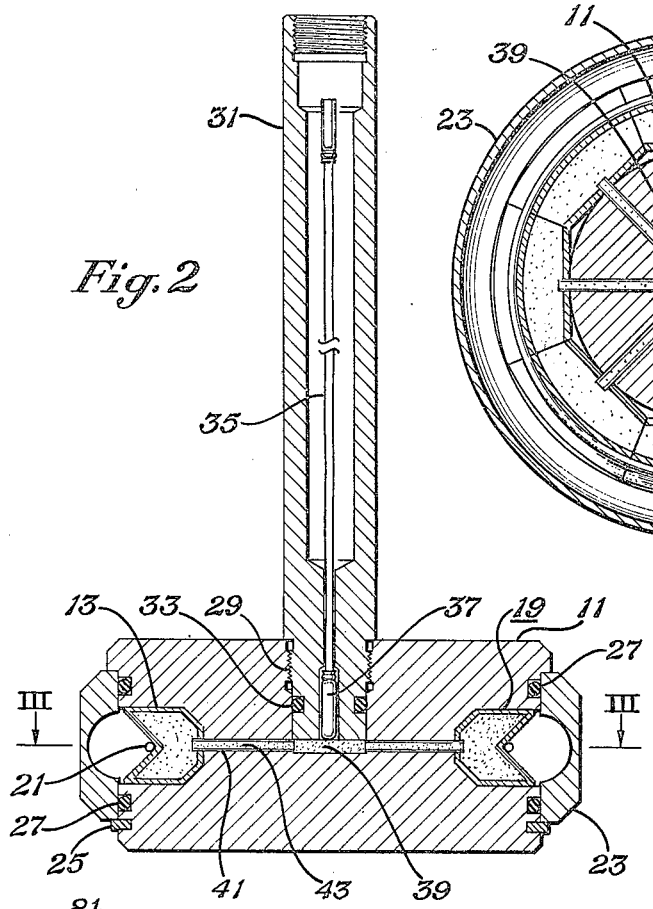
FIG. 2 is a schematic vertical section view of the assembled apparatus of FIG. 1.
Figure 3:
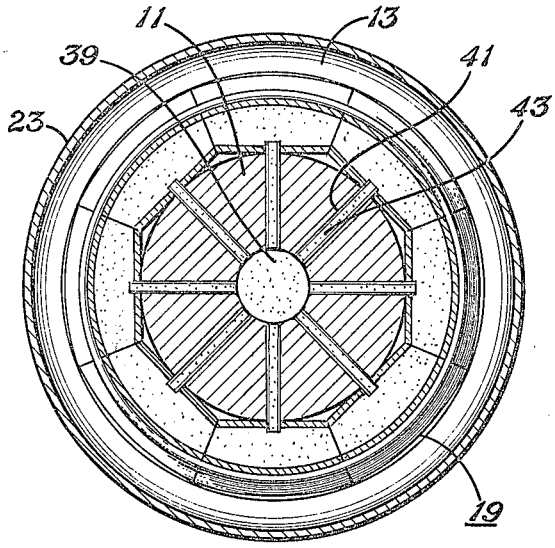
FIG. 3 is a schematic section view taken on line III—III of FIG. 2.

FIGS. 1–3 show shaped charge apparatus of the type that is to be suspended within a pipe to be cut or severed. This apparatus comprises a shaped charge carrier body 11 in the general form of a one-piece short cylinder or disk having an outwardly facing circumferential slot or groove 13 that is shaped to conform with the shape of the side and end surfaces 15, 17 of the shaped charge segments 19. A sufficient number of shaped charge segments 19 (8 or more) to make up an annular shaped charge are placed in the circumferential slot or groove 13 and are held in place by a resilient retainer ring 21. An exterior cover ring 23 mates with the outer peripheral surface of the carrier body 11 and is held in place by an exterior cover keeper 25. O-rings 27 are provided to prevent fluid entry into the charge carrier interior. The carrier body 11 has a threaded axial bore 29 extending from one side face to the central region for receiving one end of an extension sleeve 31. An O-ring 33 prevents fluid entry to the carrier body interior via the bore 29. Detonating cord 35 is carried within the extension sleeve 31 and terminates in a detonating fuse 37 which abuts an ignition pellet 39. The carrier body 11 has ignition passages 41 extending radially like spokes from the bottom of the bore 29 to the end portion of each shaped charge segment 19. These passages receive ignitor tubes 43.

Figure 11:
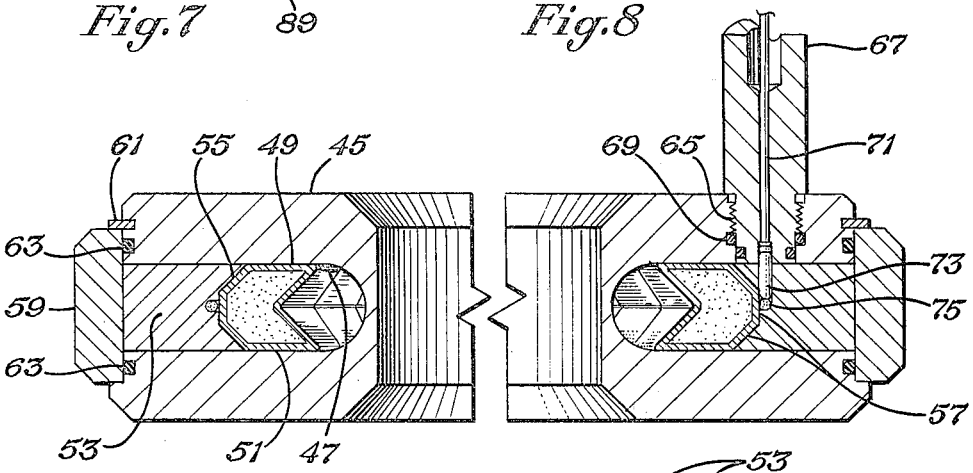
FIG. 11 is a schematic fragmentary vertical section view showing another relevant type pipe cutting apparatus utilizing an improved shaped charge configuration in accordance with the invention.
Figure 12:
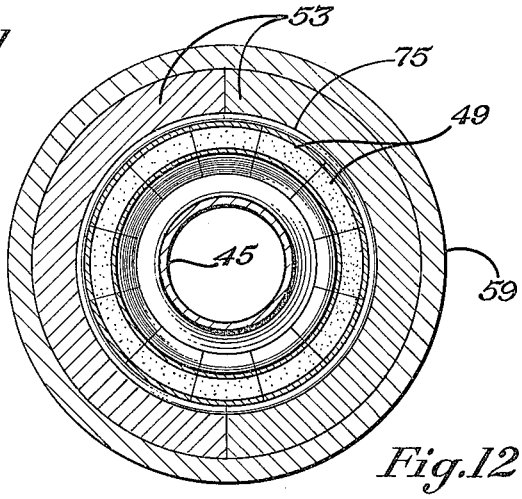
FIG. 12 is a schematic horizontal section view of the apparatus of FIG. 11.

FIGS. 11 and 12 show shaped charged apparatus of the type that surrounds the pipe to be cut or severed. This apparatus comprises a shaped charged carrier body 45 in the form of a one piece short cylinder or disc having an outward facing circumferential slot or groove 47 that is shaped to conform to the shape of the side surfaces 51 of the shaped charged segments 49. A sufficient number of shaped charge segments 49 (8 or more) to make up an annular shaped charge are placed in the circumferential slot or groove 47. A pair of semi-circular retainer segments 53 have an inward facing annular groove 55 that is shaped to conform with the end surfaces 57 of the shaped charge segements 49. The retainer segments 53 fill the remainder of the slot or groove 47 radially outward of the shaped charge segments 49. An exterior cover ring 59 mates with the outer peripheral surface of the carrier body 45 and is held in place by an exterior cover keeper 61. O-rings 63 are provided to prevent fluid entry into the charge carrier interior. The carrier body 45 has a threaded bore 65 extending from one side face to the slot or groove 47 adjacent the end surface 57 of a shaped charge segment 49 for receiving one end of an extension sleeve 67. An O-ring 69 prevents fluid entry to the carrier body interior via the bore 65. Detonating cord 71 is carried within the extension sleeve 67 and terminates in a detonating fuse 73 which abuts an ignition ring 75 that surrounds the shaped charged segments 49 and abuts their end surfaces 57.

The present invention is concerned with an improved configuration for shaped charges that are to be utilized with shaped charge apparatus of the general types above described with reference to FIGS. 1–3 and 11, 12. The present invention is also concerned with methods of making the improved shaped charges. The structures of the shaped charged apparatus exclusive of the shaped charge itself can have various forms within the scope of the present invention.

As has been hereinabove mentioned, the relevant shaped charges have the form of an annulus, and in accordance with the prior art of which I am aware, have been made in two configurations. In accordance with the first prior art configuration, the shaped charge is made up of two semi-circular segments (see U.S. Pat. No. 2,587,244). In accordance with the second prior art configuration (which is a configuration that was commonly used commercially immediately prior to the present invention) the shaped charge is made up of two complementary annulus halves, with the halves when assembled lying on opposite sides of a plane that is normal to the annulus central axis.

I have discovered that improved results can be achieved by separately manufacturing shaped charge segments in configurations such that a relatively large number of them (8 or more) when placed in side to side abutting relation will make up a single annular shaped charge.

Methods of manufacturing the relevant shaped charge segments may be explained with reference to FIGS. 5–10. The term "shaped charge segment" as used herein means shaped charged segments herein described that are to be utilized in relatively large numbers (8 or more) to make up a single annular shaped charge. The number of shaped charge segments needed to make up a single annular shaped charge will vary considerably according to the size of the cutter. In actual practice the number may vary from 8 for a 3⅝ inch O.D. cutter to 25 for a 9½ O.D. cutter.

Figure 4:
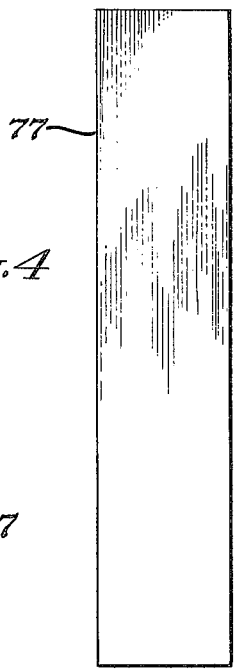
FIGS. 4–10 are schematic views illustrating various steps in the methods of making shaped charge segments for the improved shaped charge configurations.
Figure 5:
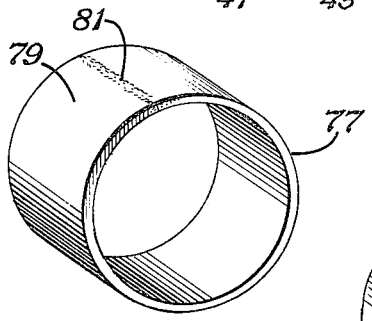
Figure 6:
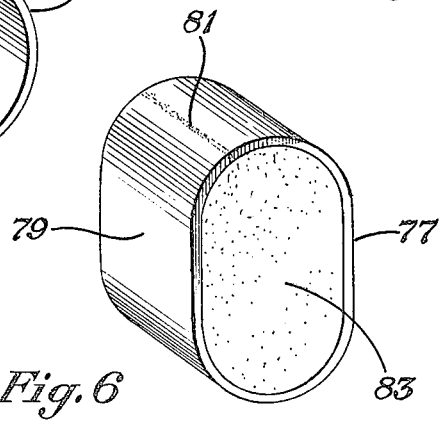
Figure 7:
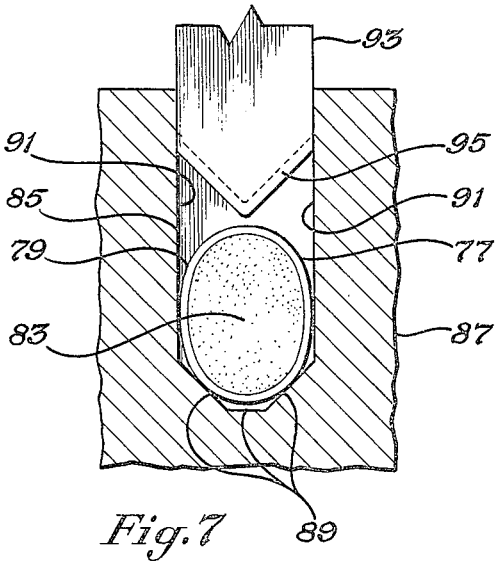
Figure 8:
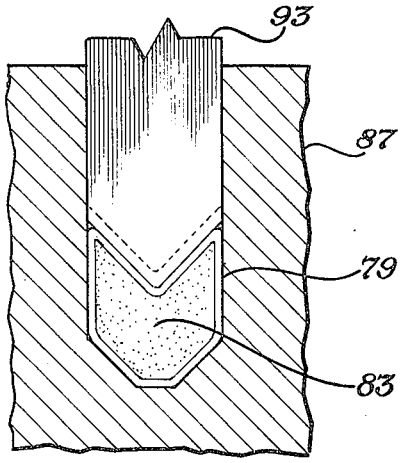

The procedure for manufacturing a shaped charge segment begins with a rectangular strip 77 (see FIG. 4) of metal sheet material of a type that is suitable for use as a shaped charge liner, e.g. dead soft copper. The rectangular strip 77 ultimately becomes a metal case or band for the shaped charge segment.

Figure 9:
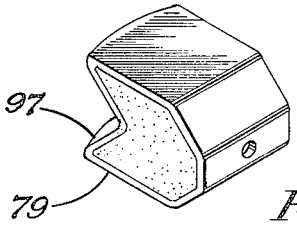

The rectangular strip 77 is first formed into the shape of a band 79 with the end edge faces abutting each other. The band is preferably a cylindrical band (see FIG. 5) and the end edge faces are preferably joined, as by brazing 81. Next, if the band is cylindrical, it is flattened on opposite sides so as to pass easily between the sidewalls of a mold or die cavity. Alternatively, the band may be originally formed to have mutually parallel opposite sidewalls spaced so as to pass easily between the mold or die cavity sidewalls. In either case the next step is to load and press charge material into the band so that the open side faces of the charge material or charge load 83 are planar and coextensive with the open side edge faces of the band 79 (see FIG. 6). Next the band 79 with its charge load 83 is placed in the cavity 85 of a mold or die 87 (see FIG. 7). The cavity 85 has bottom surfaces 89 shaped to conform with the desired shape of the bottom surfaces of the finished shaped charge segment. The cavity 85 has a first pair of side surfaces 91 spaced and shaped to conform with the desired shape and dimensions of the side surfaces of the finished shaped charge segment. The cavity has a second pair of side surfaces (not shown) that are planar and parallel and spaced so as to abut the open end faces of the band 79 and charge load 83. The mold or die 87 is provided a ram portion 93 which is reciprocable with the die cavity 85. The ram portion 93 has lower end surfaces 95 shaped to conform with the desired shape of the active face surface 97 of the finished shaped charge segment. Next the ram portion 93 is actuated to perform its stroke so as to form the shaped charged segment into its finished peripheral shape (see FIG. 8). Next, if the open end surfaces of the band 79 and its charge load 83 are parallel, as shown in FIG. 9, then these surfaces are milled to achieve the necessary taper (see FIG. 10) so that when the proper number of shaped charge segments are placed in side to side abutting relation, an annular shaped charge will result.

The length of the strip 77 will be chosen to equal the length of the total periphery of a finished shaped charge segment, which will be affected by various specific design considerations such as the size or weight of the charge load, the shape of the end surfaces of the shaped charged segment, the width of the groove or slot in the charge carrier body, the shape of the active face surface of the shaped charged segments, and the like, as will be herein further discussed.

In a typical case, for a 3⅝ inch O.D. charge carrier having a slot or groove that is 1 1/32 inch wide, the shaped charge segment may have end surfaces forming a "V" and a charge load of 14.0 grams; in which case the finished peripheral length, and consequently the length of the rectangular strip, may be about 4.00 inches. In such typical case eight shaped charge segments would be used and the width of the rectangular strip may be 1 inch, and the open sides of the finished shaped charge segment will be tapered to subtend an angle of slightly less than 45 degrees.

Figure 10:
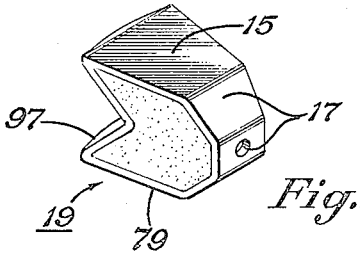

In a typical case for a 6⅜ inch O.D. charge carrier having a slot or groove that is 1.258 inches wide, the shaped charge segment may have end surfaces forming a flat bottomed "V" (as shown in FIG. 10) and a charge load of 19.0 grams; in which case the finished peripheral length, and consequently the length of the rectangular strip may be about 4.692 inches. In such typical case 16 shaped charge segments would be used and the width of the rectangular strip may be one inch, and the open sides of the finished shaped charge segment will be tapered to subtend an angle of slightly less than 22.5 degrees.

In a typical case for a 9½ inch O.D. charge carrier having a slot or groove that is 1.258 inches wide, the shaped charge segment may have a single planar end surface and a charge load of 21.5 grams; in which case the finished peripheral length, and consequently the length of the rectangular strip may be 4.692 inches. In such typical case 25 shaped charge segments would be used and the width of the rectangular strip may be one inch, and the open sides of the finished shaped charge segment will be tapered to subtend an angle of slightly less than 14.4 degrees.

It should be noted that the active face surface 97 of a shaped charge segment 19 to be used in a cutter that is suspended within a pipe is made up of two surfaces 99, 101 which are identical conical surfaces and which together have a transverse section shape in the form of a "V". The outer margins of the conical surfaces are circle segments, as is the common or inner margin. The outer margin circle segments 103, 105 have a radius equal to the maximum radii of the annular shaped charge that results from assembling the requisite number of shaped charge segments, and the inner margin circle segment 107 has a radius equal to the minimum radius of such annular shaped charge.

The steps involved in the making of shaped charge segments in accordance with the present invention may be stated as comprising:

a. forming a strip of sheet metal material of suitable length into a band;
b. filling said band and pressing within same a charge load;
c. die forming said filled band into a shaped charge segment having predetermined peripheral shape.

The side faces of the shaped charge segments must be suitably tapered so as to subtend a predetermined angle which is substantially equal to 360° divided by the number of shaped charge segments to be used to make up said annular shaped charge. This taper can be accomplished either in the die forming step or by a milling operation after the die forming step.

The steps involved in the making of an annular shaped charge for use in pipe cutting or severing apparatus may be stated as comprising:

a. forming a strip of sheet metal material of suitable length into a band;
b. filling said band and pressing with same a charge load;
c. die forming said filled band into a shaped charge segment having predetermined peripheral shape;
d. tapering the side faces of said shaped charge segment to subtend a predetermined angle which is substantially equal to 360° divided by the number of shaped charge segments to be used to make up said annular shaped charge;
e. assembling the requisite number of said shaped charge segments in side to side abutting relation to make up said annular shaped charge.

An annular shaped charge for use in pipe cutting or severing apparatus made up of eight or more shaped charge segments in accordance with the present invention has a number of advantages. Such annular shaped charge gives improved performance resulting from the fact that it is made up of shaped charge segments. The shaped charge segments can be individually manufactured in a manner that gives better control over parameters such as uniformity of thickness of the shaped charge active face surface, the geometry of the peripheral shape and particularly that of the shaped charge active face surface, and uniformity of charge load density. Such annular shaped charge has the further advantage that none of the shaped charge segments has a charge load that exceeds the maximum weight (350 grains or 22.7 grams) for shipment of explosives via commercial airline carriers.

The various materials that are commonly utilized in the manufacture of pipe cutting apparatus to which the present invention pertains are well known and consequently need not be discussed herein. Suffice it to say that the preferred material for the shaped charge segment band is dead soft copper, and the preferred charge materials are those commonly known in the trade as RDX, HMX and HNS.

The foregoing disclosure and the showings made in the drawings are merely illustrative of the principles of this invention and are not to be interpreted in a limiting sense.

I claim:

1. An annular shaped charge for use in pipe cutting or severing apparatus, which annular shaped charge is made up of eight or more shaped charge segments with each said shaped charge segment comprising a liner portion and open end portions, with the open end portions both before and after assembly each having a radial taper, with said shaped charge segments when assembled being disposed with said open end portions in side to side abutting relation, and with the liners of said shaped charge segments when assembled having a common maximum circumference and a common minimum circumference.

2. The device of claim 1 wherein each said shaped charge segment has a die formed metal band and a charge load, with each said charge load being disposed within a respective said metal band.

3. Pipe cutting or severing apparatus comprising:

a. a shaped charge carrier having the general configuration of a short cylinder or disk provided with a circumferential slot or groove that is shaped to conform with the side and end surface shape of an annular shaped charge;
b. an annular shaped charge disposed in said slot or groove and made up of eight or more shaped charge segments with each said shaped charge segment comprising a liner portion and open end portions, with the open end portions both before and after assembly each having a radial taper, with said shaped charge segments when assembled being disposed with said open end portions in side to side abutting relation, and with the liners of said shaped charge segments when assembled having a common maximum circumference and a common minimum circumference.

4. The device of claim 3 wherein each said shaped charge segment has a die formed metal band and a charge load, with each said charge load being disposed within a respective said metal band.

* * * * *